US011270712B2

(12) United States Patent
Ziv et al.

(10) Patent No.: US 11,270,712 B2
(45) Date of Patent: Mar. 8, 2022

(54) SYSTEM AND METHOD FOR SEPARATION OF AUDIO SOURCES THAT INTERFERE WITH EACH OTHER USING A MICROPHONE ARRAY

(71) Applicant: InSoundz Ltd., Tel Aviv (IL)

(72) Inventors: Ron Ziv, Kfar-Saba (IL); Tomer Goshen, Hod Hasharon (IL); Emil Winebrand, Petah Tikva (IL); Yadin Aharoni, Tel Aviv (IL)

(73) Assignee: Insoundz Ltd., Tel Aviv (IL)

( * ) Notice: Subject to any disclaimer, the term of this patent is extended or adjusted under 35 U.S.C. 154(b) by 8 days.

(21) Appl. No.: 17/003,014

(22) Filed: Aug. 26, 2020

(65) Prior Publication Data

US 2021/0065721 A1 Mar. 4, 2021

Related U.S. Application Data

(60) Provisional application No. 62/892,651, filed on Aug. 28, 2019.

(51) Int. Cl.

| | |
|---|---|
| ***G10L 19/008*** | (2013.01) |
| ***H04S 7/00*** | (2006.01) |
| ***H04R 3/00*** | (2006.01) |

(52) U.S. Cl.

CPC ..... *G10L 19/008* (2013.01); *H04R 3/005* (2013.01); *H04S 7/30* (2013.01); *H04R 2430/23* (2013.01); *H04S 2400/11* (2013.01)

(58) Field of Classification Search

CPC . G10L 19/008; G10L 21/028; G10L 21/0272; G10L 2021/02166; H04R 3/005; H04R 1/326; H04R 1/406; H04R 2430/23; H04R 2430/21; H04R 2430/25; H04R 2400/11; H04R 2201/401; H04R 2203/12; H04S 7/30; H04S 2400/11

See application file for complete search history.

(56) References Cited

U.S. PATENT DOCUMENTS

| | | | |
|---|---|---|---|
| 5,594,800 | A | 1/1997 | Gerzon |
| 5,857,026 | A | 1/1999 | Scheiber |
| 6,353,814 | B1 | 3/2002 | Weng |
| 6,498,857 | B1 | 12/2002 | Sibbald |

(Continued)

FOREIGN PATENT DOCUMENTS

GB 2506711 A * 4/2014 ..... C21D 1/06

*Primary Examiner* — Yogeshkumar Patel

(74) *Attorney, Agent, or Firm* — M&B IP Analysts, LLC

(57) ABSTRACT

A system and method for decorrelating audio data. A method includes determining a plurality of propagation vectors for each of a plurality of sound sources based on audio data captured by a plurality of sound capturing devices and a location of each of the plurality of sound sources, wherein the plurality of sound sources and the plurality of sound capturing devices are deployed in a space, wherein the audio data is captured by the plurality of sound capturing devices based on sounds emitted by the plurality of sound sources in the space; determining a plurality of beam former outputs, wherein each beam former output is determined for one of the plurality of sound sources; determining a decoupling matrix based on the plurality of beam former outputs and the propagation vectors; and decorrelating audio data captured by the plurality of sound capturing devices based on the decoupling matrix.

19 Claims, 4 Drawing Sheets

(56) References Cited

U.S. PATENT DOCUMENTS

| | | | | |
|---|---|---|---|---|
| 6,654,719 | B1 * | 11/2003 | Papadias | G06K 9/6242 704/231 |
| 7,076,072 | B2 | 7/2006 | Feng et al. | |
| 7,577,266 | B2 | 8/2009 | Feng et al. | |
| 7,775,113 | B2 | 8/2010 | Bakish | |
| 8,073,157 | B2 | 12/2011 | Mao et al. | |
| 8,437,868 | B2 | 5/2013 | Spille et al. | |
| 8,515,082 | B2 | 8/2013 | Breebaart | |
| 8,849,657 | B2 | 9/2014 | Shin | |
| 9,093,078 | B2 | 7/2015 | Hacihabiboglu et al. | |
| 9,456,289 | B2 | 9/2016 | Tammi et al. | |
| 9,538,288 | B2 | 1/2017 | Tawada | |
| 9,583,119 | B2 | 2/2017 | Nakadai et al. | |
| 9,712,937 | B2 | 7/2017 | Kitazawa | |
| 9,774,981 | B2 | 9/2017 | Jin et al. | |
| 9,779,745 | B2 | 10/2017 | Davis | |
| 9,788,108 | B2 | 10/2017 | Goshen et al. | |
| 9,998,822 | B2 | 6/2018 | Tawada | |
| 10,034,113 | B2 | 7/2018 | Kraemer et al. | |
| 10,290,312 | B2 | 5/2019 | Suzuki et al. | |
| 10,334,390 | B2 | 6/2019 | Bakish et al. | |
| 10,482,898 | B2 | 11/2019 | Liu et al. | |
| 10,720,174 | B2 | 7/2020 | Ikeshita et al. | |
| 2002/0131580 | A1 | 9/2002 | Smith | |
| 2005/0195988 | A1 | 9/2005 | Tashev et al. | |
| 2011/0123030 | A1 | 5/2011 | Deshpande | |
| 2011/0123055 | A1 | 5/2011 | Deshpande | |
| 2012/0045066 | A1 | 2/2012 | Nakadai et al. | |
| 2017/0064444 | A1 | 3/2017 | Tawada | |
| 2018/0047407 | A1 * | 2/2018 | Mitsufuji | G10L 21/028 |

* cited by examiner

SYSTEM AND METHOD FOR SEPARATION OF AUDIO SOURCES THAT INTERFERE WITH EACH OTHER USING A MICROPHONE ARRAY

CROSS-REFERENCE TO RELATED APPLICATIONS

This application claims the benefit of U.S. Provisional Application No. 62/892,651 filed on Aug. 28, 2019, the contents of which are hereby incorporated by reference.

All of the applications referenced above are hereby incorporated by reference.

TECHNICAL FIELD

The present disclosure relates generally to processing audio captured by multiple audio sources, and more specifically, to decorrelation of audio from interfering audio sources.

BACKGROUND

In the emerging field of virtual reality, it is desirable to provide mechanisms for transferring audio from a first location to a second location as accurately as possible. However, characteristics of the second location may be significantly different than those of the first location. Moreover, there may be a desire to cancel out certain sound source from the first location when recreating them in the second location. Other manipulations of sound may further be desirable such as volume adjustment, filtering out certain frequencies, and more.

Some existing solutions for selectively cancelling sounds concentrate on determining a narrow listening zone and filtering out the rest of the sounds. Typically, this is accomplished through the use of directional microphones. This is not efficient when there are more than a handful of sound sources because providing such directional microphones on a per audio source basis is complex. Moreover, if there is overlap between sound sources, the sound sources to be cancelled may be determined inaccurately.

Microphone arrays are often used to capture sounds within a space from multiple sound sources, using various beam-forming techniques. As an example, U.S. Pat. No. 8,073,157 argues that an effective way of capturing sounds via microphone arrays is using conventional microphone direction detection techniques to analyze the correlation between signals from different microphones to determine the direction with respect to the location of the source. However, this technique is computationally intensive and not robust. These drawbacks make such techniques unsuitable for use in hand-held devices and consumer electronic applications such as video game controllers. U.S. Pat. No. 8,073,157 further attempts to provide a technique operable using a hand-held device where each of the microphones of the microphone array is coupled to multiple filters. Listening sectors are then determined and audio is captured by the microphone array.

Like many existing solutions, U.S. Pat. No. 8,073,157 suggests the use of sectors that extend from the microphone array outwards. As a result, if two sound sources are within the same sector, the system will not be able to perform the desired sound separation. It would therefore be advantageous to provide a solution that overcomes the deficiencies of the prior art.

SUMMARY

A summary of several example embodiments of the disclosure follows. This summary is provided for the convenience of the reader to provide a basic understanding of such embodiments and does not wholly define the breadth of the disclosure. This summary is not an extensive overview of all contemplated embodiments, and is intended to neither identify key or critical elements of all embodiments nor to delineate the scope of any or all aspects. Its sole purpose is to present some concepts of one or more embodiments in a simplified form as a prelude to the more detailed description that is presented later. For convenience, the term "some embodiments" or "certain embodiments" may be used herein to refer to a single embodiment or multiple embodiments of the disclosure.

Certain embodiments disclosed herein include a method for decorrelating audio data. The method comprises: determining a plurality of propagation vectors for each of a plurality of sound sources based on audio data captured by a plurality of sound capturing devices and a location of each of the plurality of sound sources, wherein the plurality of sound sources and the plurality of sound capturing devices are deployed in a space, wherein the audio data is captured by the plurality of sound capturing devices based on sounds emitted by the plurality of sound sources in the space; determining a plurality of beam former outputs, wherein each beam former output is determined for one of the plurality of sound sources; determining a decoupling matrix based on the plurality of beam former outputs and the propagation vectors; and decorrelating audio data captured by the plurality of sound capturing devices based on the decoupling matrix.

Certain embodiments disclosed herein also include a non-transitory computer readable medium having stored thereon causing a processing circuitry to execute a process, the process comprising: determining a plurality of propagation vectors for each of a plurality of sound sources based on audio data captured by a plurality of sound capturing devices and a location of each of the plurality of sound sources, wherein the plurality of sound sources and the plurality of sound capturing devices are deployed in a space, wherein the audio data is captured by the plurality of sound capturing devices based on sounds emitted by the plurality of sound sources in the space; determining a plurality of beam former outputs, wherein each beam former output is determined for one of the plurality of sound sources; determining a decoupling matrix based on the plurality of beam former outputs and the propagation vectors; and decorrelating audio data captured by the plurality of sound capturing devices based on the decoupling matrix.

Certain embodiments disclosed herein also include a system for decorrelating audio data. The system comprises: a processing circuitry; and a memory, the memory containing instructions that, when executed by the processing circuitry, configure the system to: determine a plurality of propagation vectors for each of a plurality of sound sources based on audio data captured by a plurality of sound capturing devices and a location of each of the plurality of sound sources, wherein the plurality of sound sources and the plurality of sound capturing devices are deployed in a space, wherein the audio data is captured by the plurality of sound capturing devices based on sounds emitted by the plurality of sound sources in the space; determine a plurality of beam former outputs, wherein each beam former output is determined for one of the plurality of sound sources; determine a decoupling matrix based on the plurality of beam former outputs and the propagation vectors; and decorrelate audio data captured by the plurality of sound capturing devices based on the decoupling matrix.

BRIEF DESCRIPTION OF THE DRAWINGS

The subject matter disclosed herein is particularly pointed out and distinctly claimed in the claims at the conclusion of the specification. The foregoing and other objects, features, and advantages of the disclosed embodiments will be apparent from the following detailed description taken in conjunction with the accompanying drawings.

DETAILED DESCRIPTION

Figure 1A:
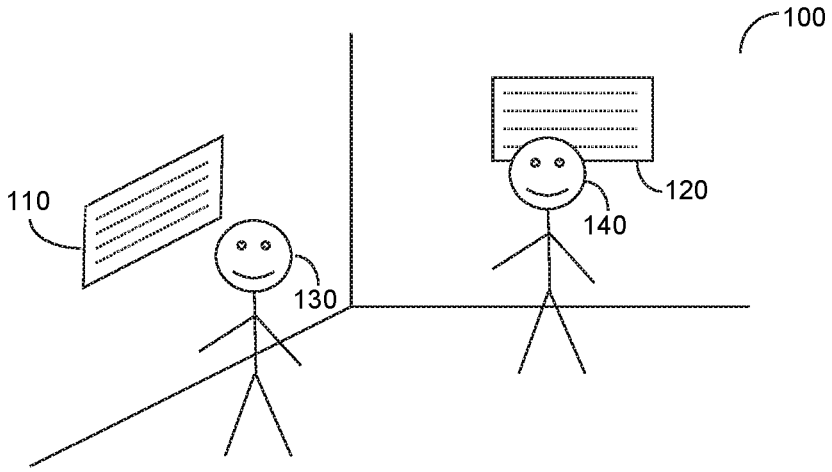
FIG. 1A is schematic isometric drawing of a space equipped with microphone arrays and having a plurality of sound sources according to an embodiment.

It is important to note that the embodiments disclosed herein are only examples of the many advantageous uses of the innovative teachings herein. In general, statements made in the specification of the present application do not necessarily limit any of the various claimed embodiments. Moreover, some statements may apply to some inventive features but not to others. In general, unless otherwise indicated, singular elements may be in plural and vice versa with no loss of generality. In the drawings, like numerals refer to like parts through several views.

In accordance with various disclosed embodiments, sound capturing devices capture sound signals from multiple sound sources. Each sound capturing device may be, but is not limited to, microphones (e.g., microphones arranged in a microphone array). Each sound source emits sound within a space and may be, but is not limited to, a person, an animal, or any other device capable of creating sound.

When multiple sound sources emit sound around the same time, sound signals captured by sound capturing devices may result in overlapping audio data which represents sounds made by multiple sound sources. It has been identified that, in a given space, interference between the plurality of sound sources results in some of the audio from one sound source leaking into each of the other sound sources' channels. Accordingly, the disclosed embodiments provide techniques for separating audio sources interfering with each other.

In an embodiment, audio from sound sources is decorrelated by using a microphone array having a number of microphones that is greater than the number of sound sources and appropriately distributed in a space. Audio from sound sources is decorrelated without causing degradation of the audio quality, for example, by using a Gram-Schmidt process. As a result, a decoupling of sound sources is achieved using a finite number of microphones.

FIGS. 1A through 1D are example schematic diagrams of a space 100 equipped with microphone arrays and having multiple sound sources utilized to describe various disclosed embodiments.

Figure 1B:
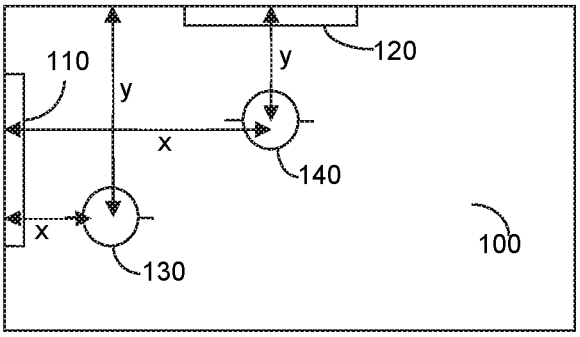
FIG. 1B is schematic top view drawing of a space equipped with microphone arrays and having a plurality of sound sources according to an embodiment.
Figure 1C:
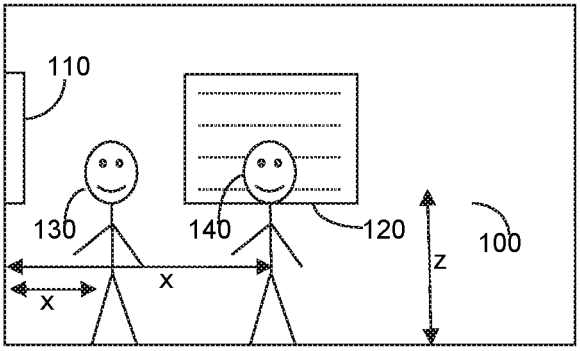
FIG. 1C is schematic front view drawing of a space equipped with microphone arrays and having a plurality of sound sources according to an embodiment.
Figure 1D:
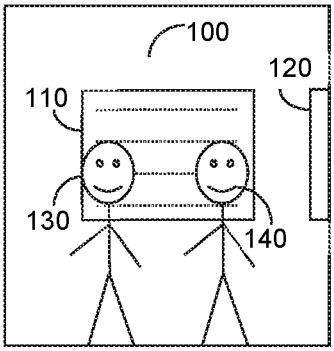
FIG. 1D is schematic side view drawing of a space equipped with microphone arrays and having a plurality of sound sources according to an embodiment.

FIG. 1A is an isometric view drawing of the space 100; FIG. 1B is a top view drawing of the space 100; FIG. 1C is a front view drawing of the space 100; and FIG. 1D is a side view drawing of the space 100.

In the example implementation shown in FIGS. 1A-D, the space 100 includes two microphone arrays 110 and 120 mounted, for example, on respective walls 150 and 160. Within the space 100, there are two persons 130 and 140 each capable of emitting sound, making each of them a sound source. From the top view shown in FIG. 1B it is possible to determine the relative position of each person 130 and 140, for example, as expressed via distances from X and Y axes represented by the walls 150 and 160. Each of the front view shown in FIG. 1C and the side view shown in FIG. 1D allows for determining the position of each of the persons 130 and 140 in respect of the Z axis of the grid.

It should be noted that the example implementation illustrated in FIGS. 1A-D include persons acting as sound sources merely for example purposes but that other sound sources such as, but not limited to, animals or artificial sound sources, may be present in the space 100 without departing from the scope of the disclosed embodiments. Additionally, two persons are illustrated in FIGS. 1A-D for example purposes, but the disclosed embodiments may be equally applicable to separating audio from three or more sound sources.

It should be further noted that a particular orientation of the room with respect to X, Y, and Z axes is described with respect to FIGS. 1A-D, but that the disclosed embodiments are not limited to this orientation. Additionally, particular surfaces such as walls are shown as aligning with respective axes, but other surfaces or arbitrarily defined axes may be utilized without departing from the scope of the disclosure.

Figure 2:
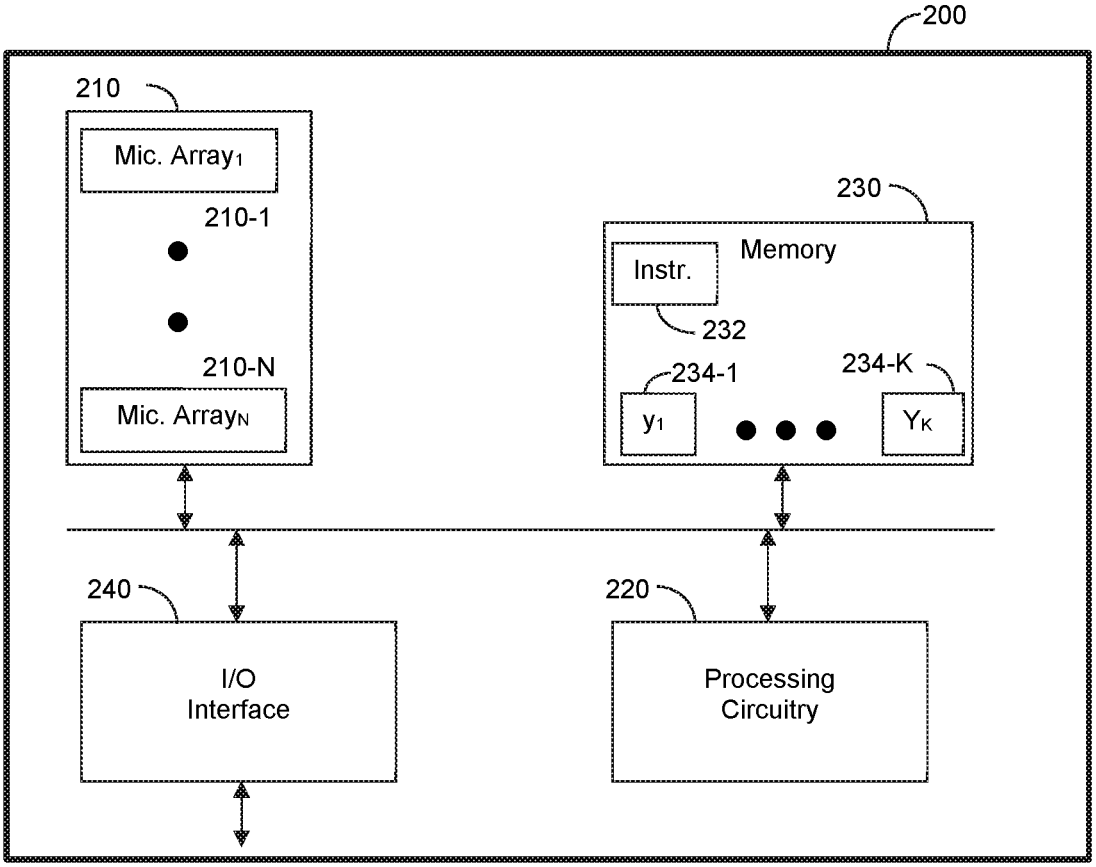
FIG. 2 is a schematic diagram of a sound separator according to an embodiment.

FIG. 2 is an example schematic diagram of a sound separator 200 according to an embodiment.

The system includes one or more microphone arrays 210 such as, for example, microphone arrays 210-1 through 210-N (where N is an integer which is or greater). Each of the microphone arrays 210 is communicatively connected to a processing circuitry 220 that may receive, either directly or indirectly, a series of sound samples captured by each of the microphones of the microphone arrays 210.

The processing circuitry 220 may be realized as one or more hardware logic components and circuits. For example, and without limitation, illustrative types of hardware logic components that can be used include field programmable gate arrays (FPGAs), application-specific integrated circuits (ASICs), Application-specific standard products (ASSPs), system-on-a-chip systems (SOCs), graphics processing units (GPUs), tensor processing units (TPUs), general-purpose microprocessors, microcontrollers, digital signal processors (DSPs), and the like, or any other hardware logic components that can perform calculations or other manipulations of information.

The processing circuitry 220 is further communicatively connected to a memory 230. The memory 420 may be volatile (e.g., random access memory, etc.), non-volatile (e.g., read only memory, flash memory, etc.), or a combination thereof.

For example, a portion of the memory 230 may be used as an instructions (Instr.) memory 232 where instructions are stored. The instructions, when executed by the processing circuitry 220, cause at least a portion of the disclosed embodiments to be performed.

The memory may further include memory portions 234, for example memory portions 234-1 through 234-K ('K' being an integer greater than '1'). Furthermore, the value of 'K' is determined based on the number of identified sound sources. More specifically, a number of memory portions 'K' is equal to the number of sound sources in a space in which audio is captured. In the example implementation shown in FIGS. 1A-D, the value of 'K' is '2' as there are two sound sources, i.e., the persons 130 and 140. Each memory portion 234 stores respective decorrelated audio for one of the sound sources generated as described herein.

An input/output (IO) interface 240 provides connectivity, for example, for the purpose of delivering audio streams captured based on sounds emitted each of the K unique sound sources, stored in memory portions 234-1 through 234-K, to a target destination (not shown). The target destination may be a sound reproduction unit that reproduces one or more of the K unique sound sources based on its unique audio stream data received from the sound separator 200. This is performed by executing, for example, a method for decoupling each of the K sources as described herein by executing a code stored in the memory 230, for example the code memory 232.

It should be noted that the microphone arrays 210 are illustrated in FIG. 2 as being integrated in the sound separator 200, but that the microphone arrays 210 may be a separate component that communicates with the sound separator 200 (for example, via the I/O interface 240) without departing from the scope of the disclosure. Further, the sound separator 200 may be deployed in the space 100, or may be deployed at a remote location from the space 100. Audio decorrelated as described herein may be projected in another space that is remote from the space 100, thereby more accurately reflecting sounds projected in the space 100.

Figure 3:
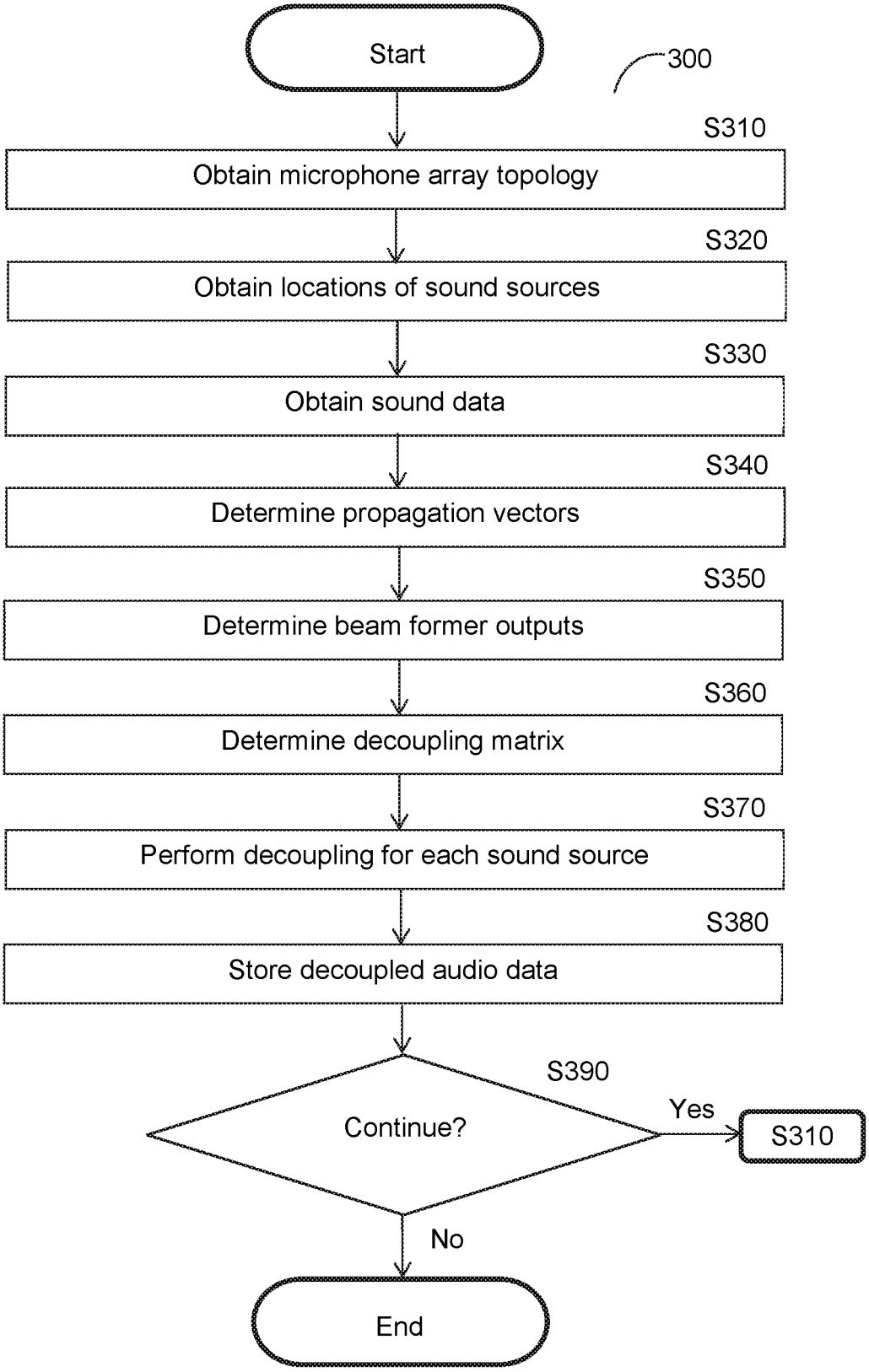
FIG. 3 a flowchart for separation of sound sources that interfere with each other using a microphone array according to an embodiment.

FIG. 3 is an example flowchart 300 illustrating a method for separating sound sources that interfere with each other using a microphone array according to an embodiment. In an embodiment, the method is performed by the sound separator 200.

At S310, a microphone array topology is received. The microphone array topology defines the position and orientation of microphones in a microphone array. The microphone array is deployed in a space including multiple sound sources.

At S320, locations of the sound sources within the space are obtained. In an embodiment, S320 includes determining the location of each sound source within the space based on visual data, audio data, both, and the like, captured within the space. In another embodiment, S320 includes receiving the locations.

At S330, audio data from microphones of the microphone array is obtained.

At S340, a set of propagation vectors $\{d_i\}_{i=1}^{k}$ is computed for each sound source based on the audio data captured by microphones of the microphone array, the microphone array topology, and sound source locations. Each propagation vector defines a magnitude and a direction of a sound emitted by one of the sound sources.

At S350, a beam former output is determined for each of the sound sources. An example technique for beam forming is described in U.S. Pat. No. 9,788,108, assigned to the common assignee, the contents of which are hereby incorporated by reference. The beam former outputs include beam former weights associated with respective sound sources.

At S360, a decoupling matrix is determined, as further discussed herein, by using the beam former weights and the set of propagation vectors $\{d_i\}_{i=1}^{k}$.

At S370, the audio data from the multiple sound sources is decoupled using the decoupling matrix.

At S380, the decoupled audio data is stored for use. In an embodiment, S380 includes storing the decoupled audio data associated with each sound source in a respective portion of memory such that audio data needed to represent each sound source may be retrieved from the respective portion of memory as needed.

The decoupled audio data may be stored either permanently or temporarily (for example, until the decoupled audio data is retrieved for use). In an example implementation, the decoupled data is immediately transmitted (e.g., via the I/O interface 240, FIG. 2), for example, for the purpose of transferring the data over a network to a destination where one or more of the decoupled sound date is used.

At S390, it is checked whether additional audio data should be processed and, if so, execution continues with S320; otherwise, execution terminates. In some implementations, the topology of the microphone array may change over time. To this end, in some implementations, execution may continue with S310 when additional audio data should be processed in order to receive new topology data. If the topology data has changed as compared to the last known topology, such data is updated.

In another implementation, the positions of all of the sound sources may be fixed such that the locations of the sound sources do not change over time. In such an implementation, execution may continue with S330 when additional audio data should be processed. In an embodiment the method is adapted to repeat the steps from S220 upon determination that the number of sound sources has changed.

In this regard, it is noted that sounds made by different sound sources in the same space may result in coupling of audio data captured based on those sounds. Using the disclosed embodiments, it is possible to create a decoupling matrix which gives a linear relation between the obtained outputs of the beam former and the physical strength of each sound originating from the location of each sound source.

In an embodiment, the numerical approach utilized in steps S330 through S370 is performed as follows. Given a specific array topology and a set of K sound sources having respective locations, the following computations and determinations may be performed.

For each sound source, a set of propagation vectors $\{d_i\}_{i=1}^{k}$ is determined based on the array topology and the location of the sound source.

A beam former output is determined for each sound source. The beam former outputs include beam former weights associated with respective sound sources.

A decoupling matrix is determined using the beam former weights and the set of propagation vectors $\{d_i\}_{i=1}^{k}$. The decoupling matrix is a matrix of equations that can be applied to audio data from the sound sources in order to separate sound produced by each of the sound sources from sounds produced by other sound sources.

Based on the beam former outputs and the decoupling matrix, the audio data is decoupled for each sound source, thereby producing separated audio data for each sound source.

Optionally, constraints may be applied in order to nullify the propagation vectors of the sound sources. By nullifying certain propagation vectors, the complexity of calculation is reduced while having a negligible effect on the results of processing. To this end, in an embodiment, the respective determination of the decoupling matrix and the decoupling are performed using the following equations. In the following equations, the values of $\{\sigma_i\}_{i=1}^{k}$ are signals from each of the K sound sources among the audio data, $\{d_i\}_{i=1}^{k}$ is the propagation vector of each sound source K, and $\{\omega_i\}_{i=1}^{k}$ is the set of beam former weights for each sound source K.

The propagation vector is applied to the sound signals as follows:

$$x=\Sigma d_i\sigma_i \qquad \text{Equation 1}$$

The output of each beam former is calculated as follows:

$$y_i = \omega_i^h \cdot x = \sum_i \sigma_i \omega_i^h \cdot d_i \qquad \text{Equation 2}$$

Therefore, a matrix operation can be introduced:

$$\begin{pmatrix} \omega_1^h d_1 & \cdots & \omega_1^h d_k \\ \vdots & \ddots & \vdots \\ \omega_k^h d_1 & \cdots & \omega_k^h d_k \end{pmatrix} \cdot \begin{pmatrix} \sigma_1 \\ \vdots \\ \sigma_k \end{pmatrix} = \begin{pmatrix} y_1 \\ \vdots \\ y_k \end{pmatrix} \qquad \text{Equation 3}$$

The matrix of Equation 3 is the vector representation for Equation 2. In Equation 3, $y_i$ is the output beamformer of the $i^{th}$ sound source, K is the number of sound sources, $\sigma_i$ is the sound source signal of the $i^{th}$ sound source, and $d_i$ is the channel between the $i^{th}$ sound source and microphone array.

A constraint is chosen such that the beam former weights of the sound sources are nullified by the propagation vectors. For the constraint $\omega_i^h \cdot d_i = 1 \forall i$, the result is:

$$\underbrace{\begin{pmatrix} 1 & \cdots & \omega_1^h d_k \\ \vdots & \ddots & \vdots \\ \omega_k^h d_1 & \cdots & 1 \end{pmatrix}}_{M} \cdot \begin{pmatrix} \sigma_1 \\ \vdots \\ \sigma_k \end{pmatrix} = \begin{pmatrix} y_1 \\ \vdots \\ y_k \end{pmatrix} \qquad \text{Equation 4}$$

The beam former weights $\{\omega_i\}_{i=1}^{k}$ may be recalculated using Equation 4 and utilized to determine the beam former output of each sound source.

The decoupling matrix M allows the solving of the above set of equations that result in the value set for the signals $\{\sigma_i\}_{i=1}^{k}$.

Performing steps S350 through S370 in accordance with Equations 1-4 allows for determining beam former outputs that separate the sound sources. One of skill in the art would therefore readily appreciate that the decoupling matrix can be solved either numerically or analytically.

The various embodiments disclosed herein can be implemented as hardware, firmware, software, or any combination thereof. Moreover, the software is preferably implemented as an application program tangibly embodied on a program storage unit or computer readable medium consisting of parts, or of certain devices and/or a combination of devices. The application program may be uploaded to, and executed by, a machine comprising any suitable architecture. Preferably, the machine is implemented on a computer platform having hardware such as one or more central processing units ("CPUs"), a memory, and input/output interfaces. The computer platform may also include an operating system and microinstruction code. The various processes and functions described herein may be either part of the microinstruction code or part of the application program, or any combination thereof, which may be executed by a CPU, whether or not such a computer or processor is explicitly shown. In addition, various other peripheral units may be connected to the computer platform such as an additional data storage unit and a printing unit. Furthermore, a non-transitory computer readable medium is any computer readable medium except for a transitory propagating signal.

All examples and conditional language recited herein are intended for pedagogical purposes to aid the reader in understanding the principles of the disclosed embodiment and the concepts contributed by the inventor to furthering the art, and are to be construed as being without limitation to such specifically recited examples and conditions. Moreover, all statements herein reciting principles, aspects, and embodiments of the disclosed embodiments, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

It should be understood that any reference to an element herein using a designation such as "first," "second," and so forth does not generally limit the quantity or order of those elements. Rather, these designations are generally used herein as a convenient method of distinguishing between two or more elements or instances of an element. Thus, a reference to first and second elements does not mean that only two elements may be employed there or that the first element must precede the second element in some manner. Also, unless stated otherwise, a set of elements comprises one or more elements.

As used herein, the phrase "at least one of" followed by a listing of items means that any of the listed items can be utilized individually, or any combination of two or more of the listed items can be utilized. For example, if a system is described as including "at least one of A, B, and C," the system can include A alone; B alone; C alone; 2A; 2B; 2C; 3A; A and B in combination; B and C in combination; A and C in combination; A, B, and C in combination; 2A and C in combination; A, 3B, and 2C in combination; and the like.

What is claimed is:

1. A method for decorrelating audio data, comprising:

determining a plurality of propagation vectors for each of a plurality of sound sources based on audio data captured by a plurality of sound capturing devices and a location of each of the plurality of sound sources, wherein the plurality of sound sources and the plurality of sound capturing devices are deployed in a space, wherein the audio data is captured by the plurality of sound capturing devices based on sounds emitted by the plurality of sound sources in the space;

determining a plurality of beam former outputs, wherein each beam former output is determined for one of the plurality of sound sources;

determining a decoupling matrix based on the plurality of beam former outputs and the propagation vectors; and decorrelating audio data captured by the plurality of sound capturing devices based on the decoupling matrix.

2. The method of claim 1, wherein a number of sound capturing devices among the plurality of sound capturing devices is greater than a number of sound sources among the plurality of sound sources.

3. The method of claim 1, further comprising:

determining a constraint for the plurality of beam former outputs such that the plurality of propagation vectors is nullified; and recalculating the plurality of beam former outputs based on the determined constraint, wherein the decoupling matrix is determined based on recalculated plurality of beam former outputs.

4. The method of claim 1, wherein the plurality of propagation vectors is determined based further on wherein the topology of the plurality of sound capturing devices defines relative positions and orientations of the plurality of sound capturing devices with respect to each other.

5. The method of claim 1, wherein the plurality of beam former outputs includes a plurality of beam former weights, wherein the decoupling matrix is determined based on the plurality of beam former weights.

6. The method of claim 1, wherein decorrelating the audio data further comprises applying the decoupling matrix to the audio data.

7. The method of claim 1, wherein the space is a first space, further comprising:

causing projection of at least a portion of the decorrelated audio data in a second space, wherein the second space is remote from the first space.

8. The method of claim 1, wherein the decorrelated audio data includes at least one portion of audio, further comprising:

storing each of the at least one portion of audio in a respective portion of storage, wherein each of the at least one portion of audio is associated with one of the plurality of sound sources.

9. The method of claim 1, wherein the plurality of sound capturing devices is a plurality of microphones of at least one microphone array.

10. A non-transitory computer readable medium having stored thereon instructions for causing a processing circuitry to execute a process, the process comprising:

determining a plurality of propagation vectors for each of a plurality of sound sources based on audio data captured by a plurality of sound capturing devices and a location of each of the plurality of sound sources, wherein the plurality of sound sources and the plurality of sound capturing devices are deployed in a space, wherein the audio data is captured by the plurality of sound capturing devices based on sounds emitted by the plurality of sound sources in the space;

determining a plurality of beam former outputs, wherein each beam former output is determined for one of the plurality of sound sources;

determining a decoupling matrix based on the plurality of beam former outputs and the propagation vectors; and decorrelating audio data captured by the plurality of sound capturing devices based on the decoupling matrix.

11. A system for decorrelating audio data, comprising:

a processing circuitry; and a memory, the memory containing instructions that, when executed by the processing circuitry, configure the system to:

determine a plurality of propagation vectors for each of a plurality of sound sources based on audio data captured by a plurality of sound capturing devices and a location of each of the plurality of sound sources, wherein the plurality of sound sources and the plurality of sound capturing devices are deployed in a space, wherein the audio data is captured by the plurality of sound capturing devices based on sounds emitted by the plurality of sound sources in the space;

determine a plurality of beam former outputs, wherein each beam former output is determined for one of the plurality of sound sources;

determine a decoupling matrix based on the plurality of beam former outputs and the propagation vectors; and decorrelate audio data captured by the plurality of sound capturing devices based on the decoupling matrix.

12. The system of claim 11, wherein a number of sound capturing devices among the plurality of sound capturing devices is greater than a number of sound sources among the plurality of sound sources.

13. The system of claim 11, wherein the system is further configured to:

determining a constraint for the plurality of beam former outputs such that the plurality of propagation vectors is nullified; and recalculate the plurality of beam former outputs based on the determined constraint, wherein the decoupling matrix is determined based on recalculated plurality of beam former outputs.

14. The system of claim 11, wherein the plurality of propagation vectors is determined based further on wherein the topology of the plurality of sound capturing devices defines relative positions and orientations of the plurality of sound capturing devices with respect to each other.

15. The system of claim 11, wherein the plurality of beam former outputs includes a plurality of beam former weights, wherein the decoupling matrix is determined based on the plurality of beam former weights.

16. The system of claim 11, wherein decorrelating the audio data further comprises applying the decoupling matrix to the audio data.

17. The system of claim 11, wherein the space is a first space, wherein the system is further configured to:

cause projection of at least a portion of the decorrelated audio data in a second space, wherein the second space is remote from the first space.

18. The system of claim 11, wherein the decorrelated audio data includes at least one portion of audio, wherein the system is further configured to:

store each of the at least one portion of audio in a respective portion of storage, wherein each of the at least one portion of audio is associated with one of the plurality of sound sources.

19. The system of claim 11, wherein the plurality of sound capturing devices is a plurality of microphones of at least one microphone array.

* * * * *